United States Patent [19]

Romer et al.

[11] 3,937,639

[45] Feb. 10, 1976

[54] PROCESS FOR THE BRIGHT ANNEALING AND RECRYSTALLIZATION OF NON-FERROUS METALS

[75] Inventors: Werner Romer, Deilinghofen; Rolf Orthey, Ludenscheid, both of Germany

[73] Assignee: Busch-Jaeger Ludenscheider Metallwerk GmbH, Ludenscheid, Germany

[22] Filed: Oct. 4, 1974

[21] Appl. No.: 512,326

[30] Foreign Application Priority Data

Oct. 9, 1973 Germany ..... 2350625

[52] U.S. Cl. ..... 148/13.2; 148/20.6; 148/28

[51] Int. Cl.[2] ..... C22F 1/08

[58] Field of Search ..... 148/13.1, 13.2, 20.6, 27, 148/28

[56] References Cited

UNITED STATES PATENTS

| | | | |
|---|---|---|---|
| 3,488,232 | 1/1970 | Cotton et al. | 148/13.2 |
| 3,801,380 | 4/1974 | Ebner | 148/13.2 |
| 3,832,240 | 8/1974 | Kubo et al. | 148/13.2 |

*Primary Examiner*—R. Dean

*Attorney, Agent, or Firm*—Haseltine, Lake & Waters

[57] ABSTRACT

A process for the bright-annealing and recrystallization of copper-zinc alloy articles consists of coating the articles with a solution of a synthetic resin and introducing the thus coated articles into an annealing furnace wherein the articles are subjected to recrystallization temperature.

5 Claims, 3 Drawing Figures

PROCESS FOR THE BRIGHT ANNEALING AND RECRYSTALLIZATION OF NON-FERROUS METALS

Figure 1:
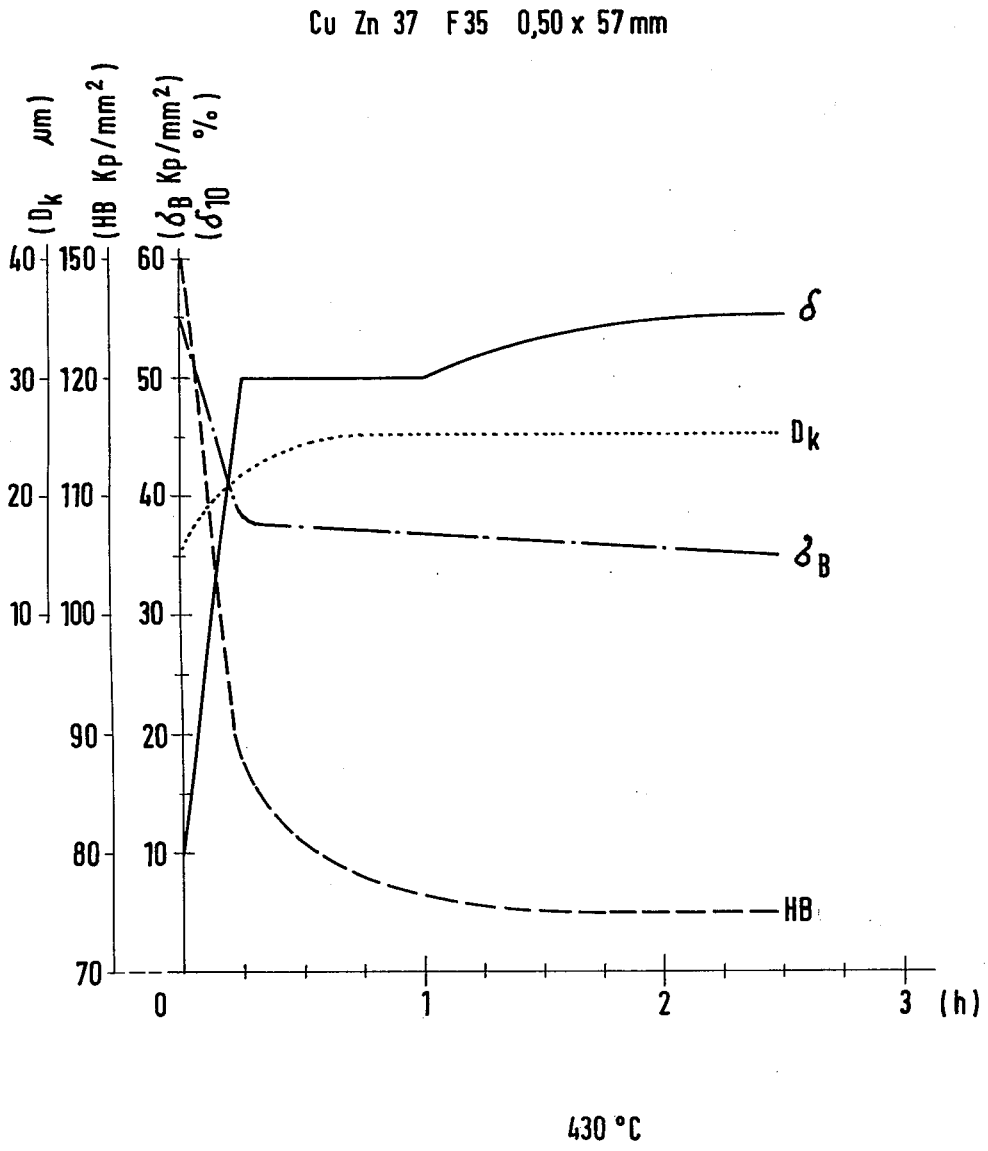

This invention relates to a process for the bright annealing and recrystallization of non-ferrous metals, more particularly semi-products of copper and zinc alloys, such as brass strip, wire and bar, in which the semiproduct is heated to recystallization temperature in an air atmosphere in an annealing furnace.

In the production of semi-products from non-ferrous metals, more particularly copper and zinc alloys, for example brass, to form strip, wire, tubes, bar material or the like, the metal is cold-worked in a multi-stage production process. Between each cold-working, the metal has to be heated to recrystallization temperature, i.e., annealed, recrystallized and then cooled. Annealing is carried out in an annealing furnace in an air atmosphere so that, for example, copper and zinc as the alloying elements of brass, or alternatively other non-ferrous metals, are oxidized by contact with atmospheric oxygen during the recrystallization process in the annealing furnace. The metal or metal alloy must therefore be pickled before the next cold-working process. The pickling acid, usually a dilute sulphuric acid solution, chemically dissolves the oxides mainly situated on the surface of the metal or alloy, namely zinc and copper oxide in the case of brass, and exposes the pure metal or metal alloy situated therebeneath. When sulphuric acid solution is used as a pickling acid, the metallic oxides are converted to sulphates and remain in solution in the pickling liquid or are diluted by the wash water in a washing process following the pickling process, and have to be discharged as an effluent. This effluent is highly contaminated, for example, by copper and zinc ions. The pickling process required results in considerable metal losses which can be recovered from the spent pickling liquid only partially by expensive additional processes such as, for example, copper electrolysis, in the case of copper.

To obviate the pickling process, therefore, numerous attempts have already been made to prevent oxidation of the metal or metal alloy during annealing for recrystallization. For example, it has already been proposed to carry out the annealing operation in a protective gas atmosphere. However, this necessitates expensive plant for preparing and purifying the protective gas required. There are also narrow limits to the size of the oven if a completely oxygen-free gas atmosphere is to be maintained. Generally, it is not possible to use a continuous annealing furnace and instead annealing has to be carried out in batch-operated furnaces. There are particular difficulties in the case of annealing brass semi-products in a protective gas atmosphere, since the production of high-purity protective gases having a high reduction potential is possible only with difficulty on an industrial scale and in addition the zinc alloying component of brass has a high vapour pressure at the conventional recrystallization temperature of 400°–650°. Similar remarks apply to chromium-nickel alloys, where chromium, like zinc, has a very high affinity for oxygen.

In heat-treatment for the tempering of steel semi-products it is known (German Patent Specification 1 803 022) to avoid atmospheric oxidation resulting in scaling by giving the steel a protective coating before heating. The protective coating consists of a suspension of ceramic frit material in an organic solvent, a non-ionic cellulose derivative being used as suspension agent. Some surface oxidation of the metal is said to occur during heating, although the coating starts to melt at higher temperatures and forms a flowable glaze which spreads uniformly over the surface of the metal and dissolves away the oxide thereon. It is stated that no further oxidation can then take place. On subsequent cooling the glaze is said to peel off because of the different coefficients of thermal expansion of the metal and the glaze, and leave a clean oxide-free metal surface.

Finally a process has been disclosed for protecting solid or liquid warm or hot metal surfaces (German Offenlegungsschrift No. 1 558 001), wherein during the treatment process the metal surface is treated with a product having reducing properties, for example boron, soda or beryllium derivatives. This process has absolutely no connection with a heat-treatment process in which a cold workpiece is provided with a coating and then heated.

The object of the invention is to find a simple process for the annealing of non-ferrous metals in which the semi-product obtained after annealing is recrystallized with a fine uniform structure and is bright without any aftertreatment.

To this end, in a process of the above type, the invention proposes that the semi-product of non-ferrous metal should be provided with a protective coating of a synthetic resin before being placed in the annealing furnace.

It has surprisingly been found that the annealing process can be decisively influenced by a synthetic resin protective coating, the term synthetic resin according to the invention being used to denote both thermoplastic and thermosetting resins. The synthetic resin protective coating so influences the recrystallization process that much more favourable physical values are obtained and a bright semi-product is produced. The decisive factor is that the entire surface of the metal or metal alloy is provided with the synthetic resin coating which, according to the invention, can be applied to the metal surface in a thin coat by brushing, spraying, sprinkling or immersion. The thickness of the coat depends on the annealing temperature and annealing time.

The synthetic resin applied is generally dissolved in a solvent and changes its state during annealing in normal annealing plant. The annealed material first appears dark-brown and then assumes a silver shade and finally again resumes its natural shade. The major part of the applied resin obviously vapourizes during the annealing process. After cooling, an ultra-thin film, which cannot be detected by normal measuring methods, apparently is left on the non-ferrous metal semi-product, which has been annealed so as to be free from oxides.

The process according to the invention gives surprising advantages and the thus annealed non-ferrous-metal semi-product or semi-product consisting of a non-ferrous metal alloy has unforeseen properties, even when the alloy contains constituents having a high affinity for oxygen.

The operations of pickling, rinsing and possibly brushing the coldworked and annealed workpiece are eliminated. Regeneration of the pickling water for recovery of the metal losses and discharge of the pickling liquor are eliminated.

Surprisingly, the annealing temperatures can be lower than in the case of workpieces not provided with a protective synthetic resin coating. In addition, annealing time can nevertheless be reduced.

Despite the reduced annealing time in comparison with the conventional process, the process according to the invention results in very advantageous recrystallization of the annealed material. A very uniform structure formation is obtained as a result of the low annealing temperatures, and this means, more particularly, prevention of coarse-grain inclusions. The structure is much more homogeneous and this manifests itself in the extraordinary softness of the annealed material. The metal semi-product annealed by the process according to the invention can therefore be worked very well in a subsequent cold-working process.

Apart from the good working properties, the semi-product annealed according to the invention can be immediately electroplated without any after-treatment. It has been found, for example, in the case of nickel-plating, that the nickel coating applied by electrodeposition can be reduced by about half. There is therefore a considerable saving of time and material in electroplating. This is obviously due to the very smooth surface produced by the annealing process according to the invention.

This is also evident from the fact that the surface of a semi-product bright-annealed according to the invention is relatively insensitive to mechanical damage and moisture influences. From this factor also one may conclude that an extremely thin synthetic resin film is left on the surface of the semi-product after annealing even if such film cannot be detected by normal measuring methods. This probable extremely thin film has no adverse effects on further treatment. On the contrary, only positive effects have been found up until now, as is apparent from the example of surface protection and electroplating.

Experiments have shown that any non-ferrous metals and metal alloys, more particularly including those having constituents with a high affinity for oxygen, can be bright-annealed and recrystallized with good structure in the temperature range from about 200° to about 650°C. It has also been found that the said temperature range is less dependent on the hitherto conventional annealing temperature of the metal or metal alloy without a protective coating than on the temperature properties of the synthetic resins used.

The following types of synthetic resin have proved suitable for the process according to the invention: phenolic resins, polyester resins, aminoresins, epoxy resins, acrylic resins, silicone resins, maleic resins, chlorinated rubber, cyclized rubber, ketone resins, colophony resins modified with phenol.

Laboratory and production experiments in the annealing of brass has shown that the following special synthetic resins are particularly good or wellsuited for the process according to the invention. The resin names given in parentheses are the trade names under which the respective resins are sold by Messrs. Reichhold-Albert-Chemie AG, Wiesbaden-Biebrich: phenolic resin (Phenodur PR 373). phenolic resin (Alresen PT 191), polyester resin (Alftalat VAN 93/1), polyester resin (Alftalat AC 371), polyester resin (Alftalat VAN 95/1), melamine resin (Maprenal WL), melamine resin (Maprenal TTX), acrylic resin (Synthacryl VSC 42), maleic resin (Alresat KM 313), maleic resin (Alresat KM 400), cyclized rubber (Alpex CK 450), epoxy resins (Beckopox EP 307).

The results of practical tests are summarized below by reference to examples. The accompanying drawings are graphs showing the material values during annealing treatment against time as follows:

FIG. 1: for brass strip CuZn 37, F 55

Figure 2:
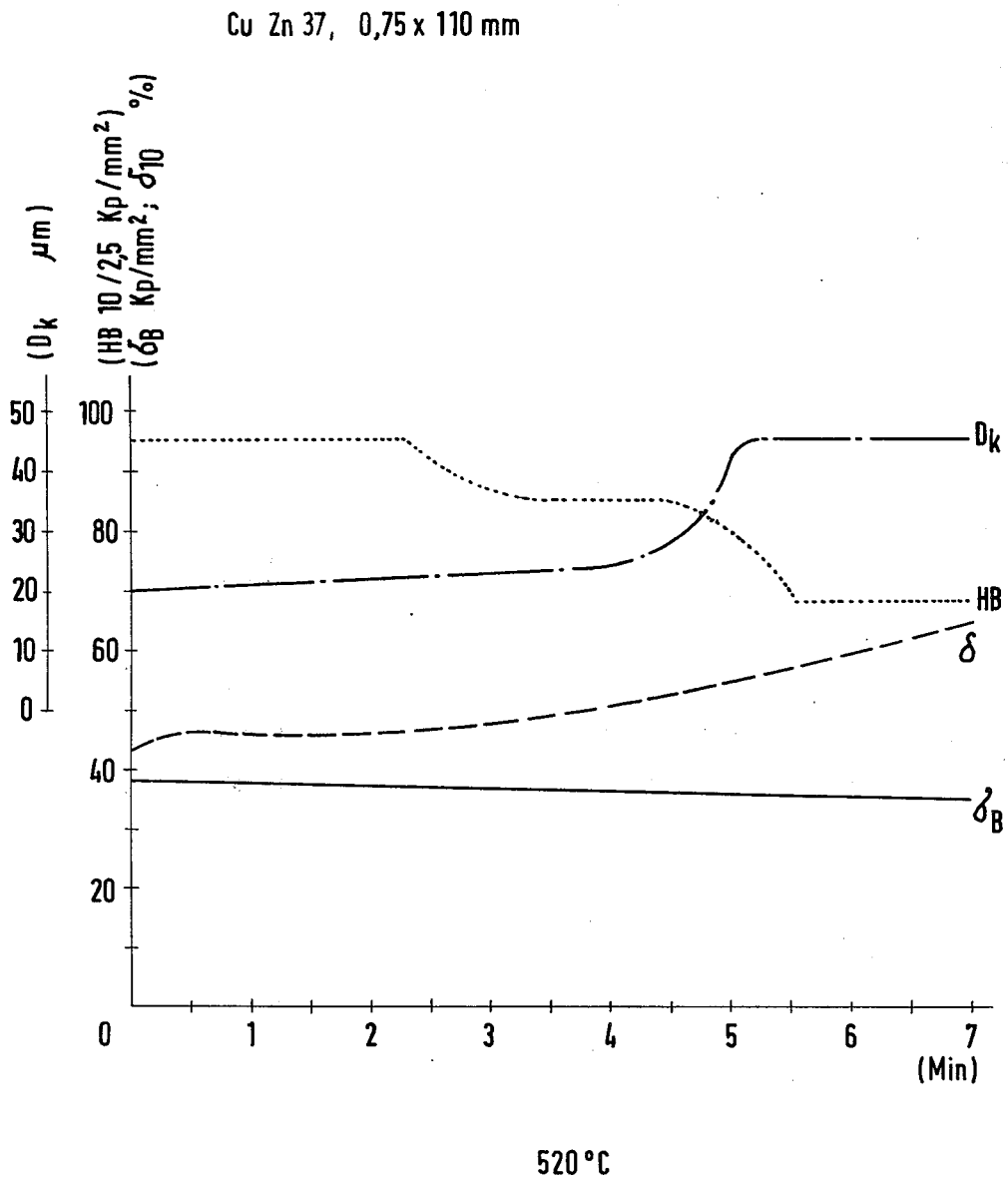

FIG. 2: for brass strip CuZn 37, bright-rolled

Figure 3:
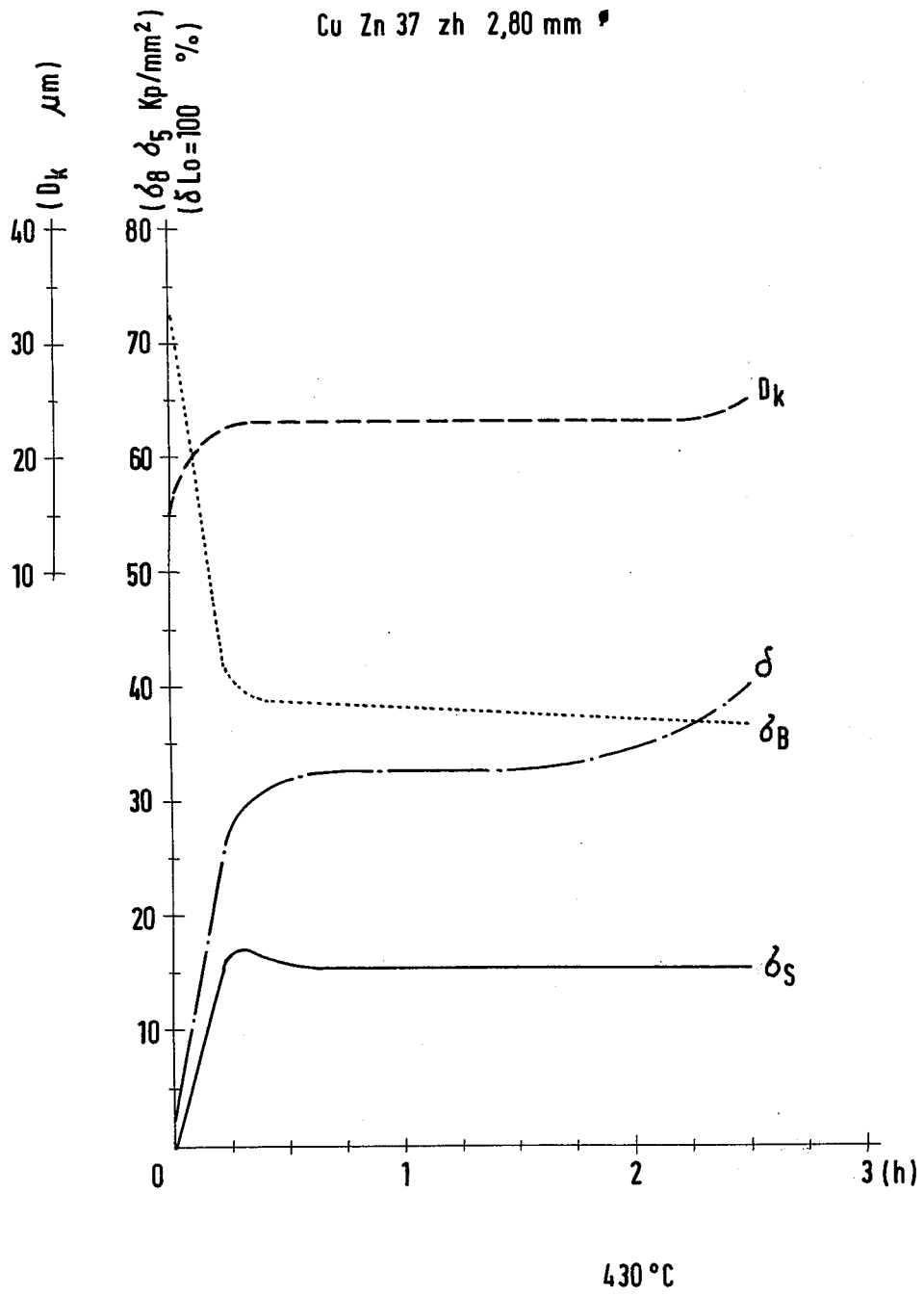

FIG. 3: for brass wire CuZn 37, drawing hardness

The following values were obtained for the annealing of brass wire in laboratory tests where:

$\sigma_s$ = Yield point in kp/mm²

$\sigma_B$ = Breaking strength in kp/mm²

$\delta$ = Elongation in %, measured length Lo = 100 mm

KG = Grain size in $\mu$m

HB = Brinell hardness in kp/mm²

Table 1

| | Annealing treatment °C | Time | $\sigma_S$ | $\sigma_B$ | $\delta$ | KG |
|---|---|---|---|---|---|---|
| | 1. Wire 0.80 mm dia. cold working (cross-section variation) 91.8% | | | | | |
| without annealing treatment | — | — | — | 95,3 | 3 | — |
| without synthetic resin coating | 470° | ½ hour | — | 47,7 | 31 | xx) |
| with synthetic resin coating | 470° | ½ hour | — | 42,5 | 43 | 17 |
| | 2. Wire 3.40 mm dia. cold working (cross-section variation) 58.8% | | | | | |
| without annealing treatment | — | — | — | 73,1 | 2 | — |
| without synthetic resin coating | 450° | 1 hour | 17,6 | 39,8 | 35 | 23 X |
| | 450° | 1,5 hours | 15,8 | 39,8 | 34 | 25 x) |
| with synthetic resin coating | 450° | 1 hour | 17,6 | 40,2 | 39 | 27 |
| | 450° | 1,5 hours | 14,8 | 39,2 | 42 | 27 |
| | 3. Wire 3.70 mm dia. cold working (cross-section variation) 51.4% | | | | | |
| without annealing treatment | — | — | — | 67,1 | 3 | — |
| without synthetic resin coating | 450° | 2 hours | 14,8 | 39,7 | 32 | 27 |
| with synthetic resin | | | | | | |

Table 1-continued

| | Annealing treatment °C | Time | $\sigma_S$ | $\sigma_B$ | δ | KG |
|---|---|---|---|---|---|---|
| | 1. Wire 0.80 mm dia. cold working (cross-section variation) 91.8% | | | | | |
| coating | 450° | 2 hours | 14,1 | 38,1 | 45 | 27 |
| | 4. Wire 4.20 mm dia. cold working (cross-section variation) 75.5% | | | | | |
| without annealing treatment | — | — | — | 67,5 | 3 | — |
| without synthetic resin coating | 430° | 3 hours | 20,5 | 42,5 | 31 | 16 x) |
| | 450° | 2 hours | 16,6 | 39,3 | 34 | 23–60 |
| | 470° | ½ hour | 23,6 | 44,4 | 31 | 15 x) |
| with synthetic resin coating | 430° | 3 hours | 18,0 | 39,2 | 43 | 21 |
| | 450° | 2 hours | 17,8 | 38,8 | 42 | 21 |
| | 470° | ½ hour | 16,9 | 39,1 | 42 | 23 |

x) not completely recrystallised
xx) deformed (no recrystallisation)

The following values were obtained in the annealing of brass strip CuZn 37:

Table II

| | Annealing treatment °C | Time | $\sigma_S$ | $\sigma_B$ | δ | HB | KG |
|---|---|---|---|---|---|---|---|
| | 1. Brass strip CuZn 37, bright rolled F 40, 0.50 × 100 m | | | | | | |
| without annealing treatment | — | — | 30,6 | 40,7 | 44 | 102 | 17 |
| without synthetic resin coating | 500° | 5 Min. | 22,8 | 37,6 | 47 | 89 | 20 x) |
| | 520° | 3 Min. | 23,0 | 37,8 | 47 | 89 | 20 x) |
| | 550° | 2 Min. | 23,1 | 38,6 | 47 | 87 | 20 x) |
| | 570° | 2 Min. | 17,4 | 36,2 | 49 | 80 | 27 |
| with synthetic resin coating | 500° | 5 Min. | 19,0 | 37,0 | 61 | 81 | 23 |
| | 520° | 3 Min. | 19,2 | 36,5 | 62 | 80 | 25 |
| | 550° | 2 Min. | 17,3 | 36,3 | 64 | 77 | 25 |
| | 570° | 2 Min. | 14,2 | 34,0 | 67 | 65 | 42 |
| | 2. Brass strip CuZn 37, F 55, 0,50 × 57 mm | | | | | | |
| without annealing treatment | — | — | 55,4 | | 10 | 150 | — |
| without synthetic resin coating | 430° | 1 hour | 34,9 | | 56 | 72 | 23 – 30 |
| | 430° | 2 hours | 34,6 | | 59 | 70 | 25 – 37 |
| | 520° | 5 Min. | 35,2 | | 60 | 69 | 25 – 33 |
| with synthetic resin coating | 430° | 1 hour | 36,9 | | 50 | 81 | 25 |
| | 430° | 2 hours | 35,7 | | 55 | 74 | 25 |
| | 520° | 5 Min. | 35,7 | | 53 | 70 | 23 |

x) not completely recrystallised

A comparative annealing using CuZn 37 brass strip, bright, was carried out in a production test. Annealing was carried out in an electrical furnace with three temperature zones set to 750° – 650° – 570°C. The speed of passage through the furnace was 1.2 m/min.

Table III

| | Dimensions mm | $\sigma_S$ | $\sigma_B$ | δ | HB | KG |
|---|---|---|---|---|---|---|
| unannealed | 0,80×86 | 29,6 | 40,3 | 53 | 102 | 17 |
| without protective synthetic resin coating | 0,80×86 | | | | | |
| with protective synthetic resin coating | 0,80×86 | 14,9 | 35,0 | 65 | 69 | 30 |
| unannealed | 0,90×70 | 27,5 | 39,4 | 53 | 97 | 17 |

Table III-continued

| | Dimensions mm | $\sigma_S$ | $\sigma_B$ | δ | HB | KG |
|---|---|---|---|---|---|---|
| without synthetic resin coating | 0,90×70 | | | | | |
| with synthetic resin coating | 0,90×70 | 14,7 | 35,0 | 65 | 65 | 30 |

In all the laboratory and practical experiments the wires or strip were annealed only in accordance with the proposal of the invention without any subsequent pickling and brushing. In each case a perfect bright and soft annealed quality was obtained. In a practical test for further processing of the semi-product, finished products, more particularly rosettes, were made from the size 0.80 x 86 mm brass strip, using, on the one hand, material annealed, pickled and polished by the prior-art process and, on the other hand, strip material annealed by the process according to the invention.

The finished products or rosettes were stamped in one operation and deep-drawn in a second operation.

The parts annealed by the prior-art process were given a nickel or chromium coating of up to 16 $\mu$m. The nickel or chromium coating in the case of the parts stamped and deep-drawn from the strip annealed according to the invention was only 8 $\mu$m after half the passage time through the electroplating system, and yet the appearance of these parts was much better.

In a corresponding practical test with brass strip of the size 0.90 x 70 mm, nickel-plated or chromium-plated parts produced from brass strip material annealed by the prior-art process was subsequently alos polished. When brass strip annealed by the process according to the invention was used it was surprisingly found that polishing could be dispensed with after electroplating.

The said practical tests appeared to prove that the process according to the invention gives an extremely smooth and uniform bright surface which enables electroplating to be carried out with thinner coatings and also ensure that subsequent polishing can be dispensed with.

In addition to the symbols already explained in the case of Table I, the symbol used in the accompanying drawings have the following meanings;

$D_k$ = KG = Grain size $\delta_{10} = \delta$ = Elongation Lo = 100 mm $F_{40}$ = DIN Breaking strength about 40 kp/mm$^2$ $F_{55}$ = DIN Breaking strength about 55 kp/mm$^2$ zh = Drawing-hard, without any strength value to be complied with.

We claim:

1. In a process for the bright-annealing and recrystallization of copper-zinc alloy articles in the form of strip, wire and bar material, in which such articles are heated to recrystallization temperature in an air atmosphere in an annealing furnace, the improvement which comprises applying to such articles a coating of a liquefied synthetic resin dissolved in a solvent therefor and introducing the thus coated articles into the annealing furnace and subjecting the articles to recrystallization temperature therein.

2. A process according tc claim 1, wherein the synthetic resins used are both thermoplastic and thermosetting resins.

3. A process according to claim 2, wherein the synthetic resin coating is applied by means of a brush or roller.

4. A process according to claim 2, wherein the synthetic resin coating is applied by spraying or sprinkling by means of a spray device.

5. A process according to claim 2, wherein the synthetic resin coating is applied by dipping the articles into an immersion bath disposed upstream of the annealing furnace.

* * * * *